United States Patent [19]

Paul

[11] 3,979,907

[45] Sept. 14, 1976

[54] PRIORITY CONTROL VALVE

[75] Inventor: John C. Paul, Willoughby Hills, Ohio

[73] Assignee: Parker-Hannifin Corporation, Cleveland, Ohio

[22] Filed: Sept. 10, 1973

[21] Appl. No.: 395,970

[52] U.S. Cl. ..... 60/422; 60/484; 91/412; 137/101

[51] Int. Cl.[2] ..... F15B 15/18

[58] Field of Search ..... 91/412, 413, 421, 433, 91/DIG. 2, 414; 137/101; 60/422, 427, 445, 450

[56] References Cited

UNITED STATES PATENTS

| | | | |
|---|---|---|---|
| 2,827,768 | 3/1958 | Ziskal et al. | 91/412 |
| 2,892,311 | 6/1959 | Gerpen | 60/450 X |
| 2,892,312 | 6/1959 | Allen et al. | 60/450 X |
| 3,334,705 | 8/1967 | Lam | 60/422 X |
| 3,391,537 | 7/1968 | Smith | 60/422 X |
| 3,410,295 | 11/1968 | Malott | 91/28 X |
| 3,470,694 | 10/1969 | Budzich | 60/427 |
| 3,543,516 | 12/1970 | Treichel | 60/422 X |
| 3,584,538 | 6/1971 | Peterson | 91/421 |
| 3,662,548 | 5/1972 | Suzuki et al. | 91/412 X |
| 3,703,186 | 11/1972 | Brewer | 137/101 |
| 3,726,093 | 4/1973 | Malott | 60/445 |
| 3,760,830 | 9/1973 | Fritzsche et al. | 137/101 |

*Primary Examiner*—Carlton R. Croyle
*Assistant Examiner*—Edward Look
*Attorney, Agent, or Firm*—Donnelly, Maky, Renner & Otto

[57] ABSTRACT

A priority control valve for the priority steering control and the auxiliary circuits of the hydraulic system of a fork lift truck or the like characterized in that the housing interchangeably accommodates different priority flow control spools according to the type of steering control valve which is used i.e. a closed center steering control valve with a variable meter-in orifice in the pressure feed circuit or a closed center steering control valve with a variable meter-out orifice in the steering cylinder return circuit or an open center steering control valve with an orifice in the priority flow divider spool to determine the priority circuit flow by controlling a variable displacement pump when the priority circuit itself is operated or when the priority circuit load pressure is greater than the load pressure of the auxiliary circuit.

6 Claims, 5 Drawing Figures

PRIORITY CONTROL VALVE

BACKGROUND OF THE INVENTION

It is known to provide flow divider and priority valves in connection with priority circuit and auxiliary circuit control valves so that desired pump flow to the priority circuit is assured with the balance of the pump flow being available for operation of fluid motors in the auxiliary circuit. In the case of a hydraulic system for a fork lift truck, the priority circuit may include the power steering control valve and the auxiliary circuit may include the lift and tilt control valves. For examples of known flow divider and priority valves reference may be had to the following patents: Martin U.S. Pat. No. 3,160,167, Stacey U.S. Pat. No. 3,376,892, Cleminshaw et al. U.S. Pat. No. 3,415,265, and Stacey U.S. Pat. No. 3,456,671.

SUMMARY OF THE INVENTION

This invention relates to a priority control valve which comprises a housing having priority circuit supply and return ports adapted to be connected to the directional control valve of the priority circuit, an inlet port adapted to be connected to a fluid pressure source such as a variable displacement pump (or a fixed displacement pump if desired), and an auxiliary supply port adapted to be connected to the inlet port of a directional control valve or valves in the auxiliary circuit, said inlet, priority supply, and auxiliary supply ports intersecting a bore in said housing in which a spring biased priority spool is movable, said priority spool being of any one of several different forms according to the various types of priority circuit directional control valves. In addition, the housing aforesaid is otherwise modified according to various priority and auxiliary circuit features. In any event, the basic housing is of a universal nature to accommodate various differences in priority and auxiliary circuit features.

DETAILED DESCRIPTION OF THE PREFERRED EMBODIMENTS

The priority control valve herein is adapted to be used as in the hydraulic system of a fork lift truck or like mobile equipment in which the priority circuit is the power steering circuit and the auxiliary circuit includes the lift, tilt, etc. cylinders, said priority control valve being operative to satisfy the flow demands of the power steering circuit with the balance of the pump output being diverted to the auxiliary circuit.

Figures 1, 1A:
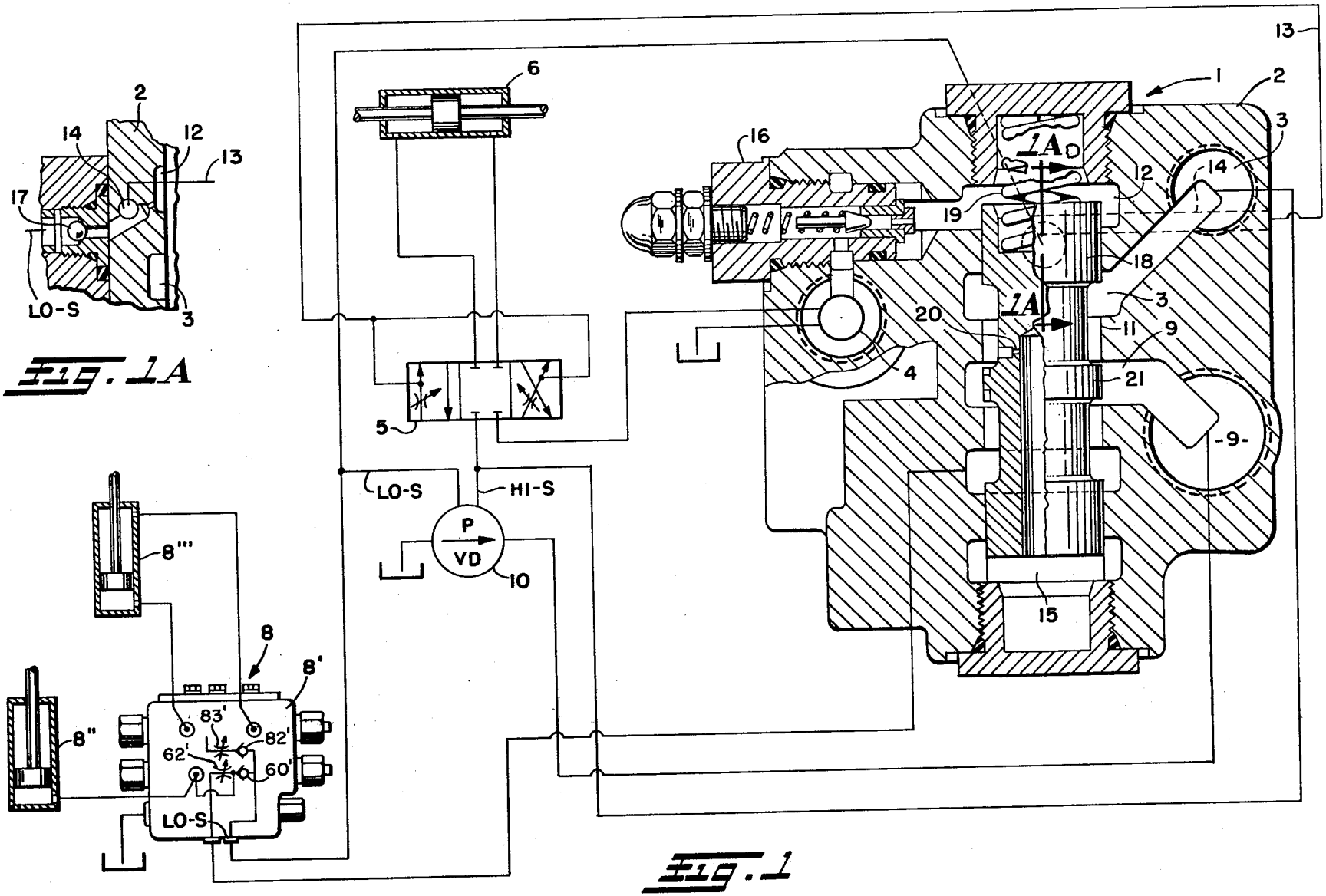
FIG. 1 is a cross-section view of one form of priority control valve in accordance with the present invention, such section having been taken through the flow divider and priority control spool.
FIG. 1A is a fragmentary cross-section view taken substantially along the line 1A—1A, FIG. 1.

Priority Control Valve For Use With a Variable Displacement Pump and With a Four-Way Closed Center Steering Control Valve Defining a Variable Area Meter-In Orifice The priority control valve 1 shown in FIGS. 1 and 1A comprises a housing 2 having priority circuit supply and return ports 3 and 4 which in the power steering circuit of a fork lift truck or the like are connected to the respective inlet and return ports of a four-way closed center steering control valve 5 having a variable area meter-in orifice for controlling the direction and speed of operation of the steering cylinder 6. The housing 2 also has an auxiliary circuit supply port 7 which is adapted to be connected to supply fluid under pressure to the auxiliary circuit 8 which by way of example may be an integrated pressure compensated load sensing system as disclosed in the co-pending application of John C. Paul, Ser. No. 394,560, filed Sept. 6, 1973, now U.S. Pat. No. 3,866,419, dated Feb. 18, 1975. Fluid under pressure is conducted to the priority and auxiliary circuits through an inlet port 9 which is adapted to be connected to a variable displacement pump 10 such as disclosed in said U.S. Pat. No. 3,866,419 and in Malott, U.S. Pat. No. 3,726,093. Said auxiliary circuit 8 is herein shown as comprising a directional control valve 8' having a three way spool for controlling a lift cylinder 8'' and a four way spool for controlling a mast tilt cylinder 8'''.

As disclosed in said U.S. Pat. No. 3,866,419 the directional control valve 8' has a low signal port LO-S which is connected as shown to the low signal line LO-S of the pump 10 controller, and which is downstream of variable area orifices 62' and 83' (corresponding to the orifices 62 and 83 in FIGS. 3 and 4 of said U.S. Pat. No. 3,866,419) defined by actuation of the spools of valve 8', there being check valves 60' and 82' (see check valves 60 and 82 in FIGS. 3, 4, and 7 of U.S. Pat. No. 3,866,419) similar to check valve 17 (FIG. 1A) downstream of the respective variable area orifices 62' and 83'. The lift spool circuit is shown in position to lift the piston in cylinder 8''. The orifice 83' also corresponds to the orifice in the steering control valve 5. Also, as disclosed in said U.S. Pat. No. 3,866,419, the lift and tilt spools will have pressure compensating spools associated therewith to maintain selected speeds of actuation of the respective lift and tilt cylinders 8'' and 8''' irrespective of variation of cylinder loads.

The housing 2 has a bore 11 which is intersected axially therealong by a passage 12 which communicates by way of conduit 13 and passage 14 with the downstream side of a variable area meter-in orifice defined by operation of the closed center power steering control valve 5 (also see Malott U.S. Pat. No. 3,726,093 and U.S. Pat. No. 3,866,449 for examples of closed center variable area meter-in valves), by a priority circuit supply passage 3 which also is the HI-S high signal passage which senses the fluid pressure upstream of the aforesaid variable area meter-in orifice of the power steering control valve 5, by a pressure inlet passage 9 for connection with the variable displacement pump 10, by an auxiliary circuit 8 supply passage 7, and by a passage 15 which is not used in the FIG. 1 embodiment but is used in the FIG. 2 embodiment. If it be desired to provide a maximum pressure limit in the priority circuit, the housing 2 may be bored as shown in FIG. 1 to receive a relief valve 16 which relieves excess pressure from the passage 12 to the return passage 4.

As shown in FIG. 1A, the LO-S signal passages 14 and 12 are communicated with the controller for the variable displacement pump 10 through a check valve 17. By reference to said U.S. Pat. No. 3,866,419 it can be seen that the check value 17 functions in the manner of the check valves employed in the auxiliary directional control valve 8' and in connection with the directional control valve assembly of U.S. Pat. No. 3,866,419 whereby in the present case when the steering control valve 5 is operated by itself, the LO-S signal pressure is conducted to the pump controller to upstroke the pump to maintain a predetermined flow to the priority circuit according to the size of the variable area meter-in orifice of the power steering control valve 5.

Reciprocable in the bore 11 is a flow divider and priority control spool 18 which is actuated by the spring 19 and which at its opposite ends is exposed to LO-S pressure in the passage 12 and to HI-S pressure which reaches the chamber 15 through the spool orifice 20.

The priority spool 18 has an intermediate land 21 provided with metering notches which pinch down the flow from the inlet passage 9 to the auxiliary supply passage 7 so that the demand set by the meter-in orifice of the power steering control valve 5 is satisfied and, when the flow demand, and hence the HI-S to LO-S pressure drop across said meter-in orifice, is satisfied, the priority spool 18 moves against the spring 19 to pinch down the flow to the priority circuit and to increase the flow from the inlet passage 9 to the auxiliary supply passage 7. By way of illustrative example, the pump controller may be operative to maintain a pressure drop of 75 psi whereas the priority spool is operative at a lower pressure drop, for example, from 25 to 50 psi. Thus, when the power steering control valve 5 is the only valve which is actuated, the variable displacement pump 10 will be upstroked until the pressure drop between HI-S and LO-S via the check valve 17 is 75 psi, but, because the priority spool is set at a lower pressure drop the flow to the priority circuit is restricted by the metering land 21 to create a pressure drop in addition to the desired pressure drop across the meter-in orifice. When the directional control valve 8 in the auxiliary circuit 8 is actuated to operating position to control cylinder 8'' (or cylinder 8''') or both of them at the same time that the power steering control valve 5 is in operating position, the auxiliary circuit 8 can receive fluid only in excess of that demanded by the priority circuit.

Figure 2:
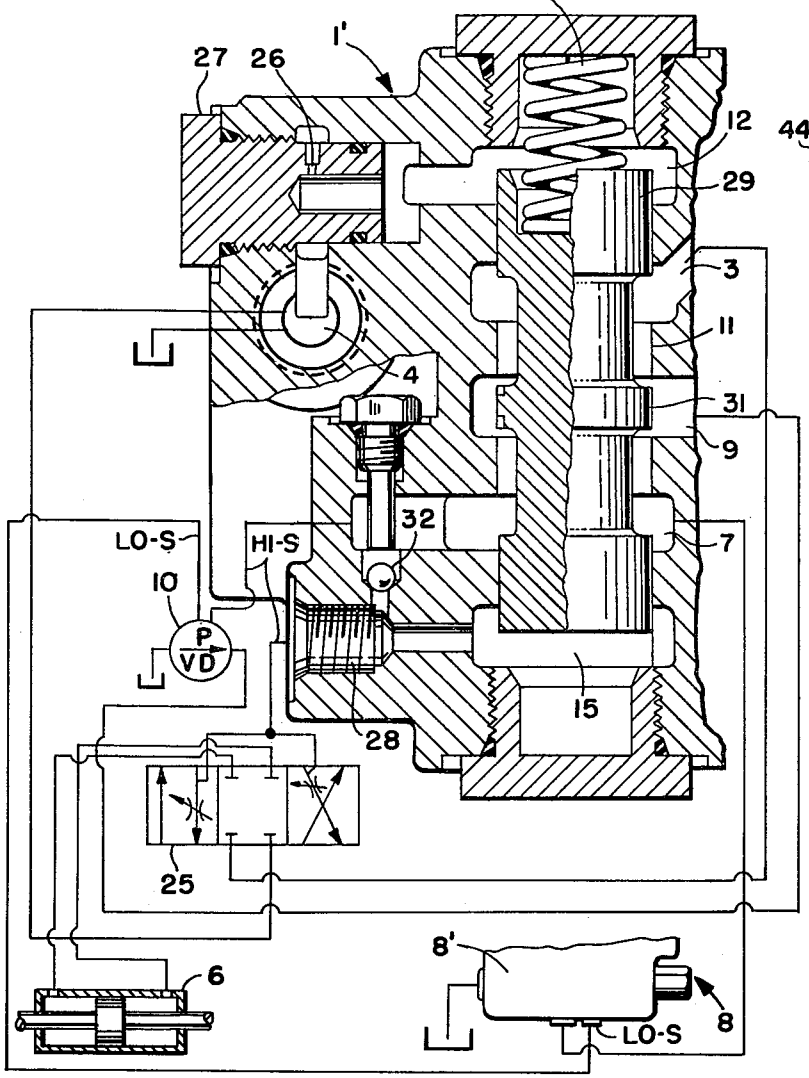

The FIG. 2 Priority Control Valve for Use with a Variable Displacement Pump and with a Four-Way Closed Center Power Steering Control Valve Having a Variable Area Meter-Out Orifice The priority control valve 1' shown in FIG. 2 uses basically the same housing 2 as FIG. 1 having a bore 11 intersected by an LO-S signal passage 12, a priority circuit supply passage 3, an inlet passage 9 from the variable displacement pump 10, an auxiliary circuit supply passage 7, and a HI-S signal passage 15. In this case, because the priority circuit supply passage is connected to a closed center power steering control valve 25 having a variable area meter-out orifice, the LO-S signal passage 12 is communicated with tank pressure via an orifice 26 in a plug 27 installed in the housing 2 in place of the relief valve 16 in FIG. 1. Thus, the chamber 12 senses pressure downstream of the variable area meter-out orifice of the power steering control valve 25.

The housing 2 of FIG. 2 has a port 28 which is connected to the power steering control valve 25 to sense pressure upstream of the variable area meter-out orifice of valve 25 whereby the pressure sensed in the chamber 15 is the pressure upstream of the meter-out orifice.

Reciprocable in the bore 11 is the priority spool 29 which is actuated by the spring 30 and which has its opposite ends exposed to HI-S and LO-S pressure in chambers 15 and 12 which are the pressures respectively upstream and downstream of the variable area meter-out orifice in the power steering control valve 25. The priority spool 29 is in this case of solid construction and the metering land 31 with the metering notches enables pinching down of the flow either to the priority circuit or to the auxiliary circuit thus to assure satisfaction of the flow demand set by the priority circuit control valve 25 with the excess being available for use in the auxiliary circuit 8. In this case, the steering circuit HI-S controls the variable displacement pump 10 when no other functions are actuated. When other functions of any pressure level above say 100 to 200 psi are actuated, they control the variable displacement pump 10, locking out the steering HI-S signal at the ball check 32 between the passage 15 and the auxiliary supply passage 7 but the priority spool 29 yet directs the priority flow to the steering circuit until it is satisfied and, of course, the balance is available to the other functions. As evident, the check valve 32 permits flow of the HI-S signal from the steering circuit into the HI-S circuit of the pump auxiliary controller (see, U.S. Pat. No. 3,866,419, for example) when no other functions are actuated.

Figure 3:
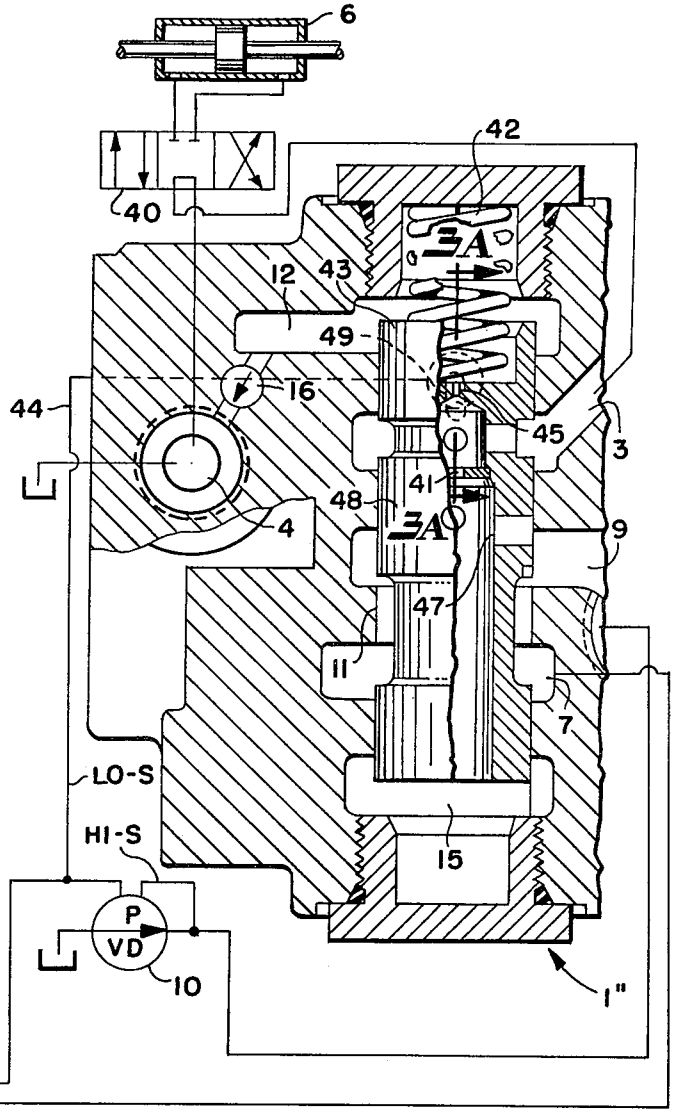
FIGS. 2 and 3 are cross-section views similar to FIG. 1 illustrating other forms of priority control valves embodying the present invention.
Figure 3A:
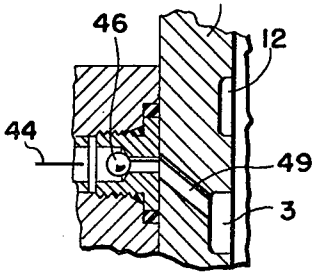
FIG. 3A is a cross-section view taken substantially along the line 3A—3A, FIG. 3.

The FIGS. 3 and 3A Priority Control Valve For Use With Four-Way Open Center Power Steering Control Valve The priority control valve 1'' of FIGS. 3 and 3A employs a housing 2 basically of the same construction as that of FIGS. 1 and 2 and if it is desired to limit the priority circuit pressure, a relief valve 16 may be installed as in FIG. 1 between the LO-S passage 12 and the return passage 4. In this example, the priority circuit supply passage 3 is connected to an open center power steering control valve 40 and the priority flow is of fixed value as determined by a fixed orifice 41 in the spring 42 actuated priority spool 43 in bore 11. The lower end of the priority spool in chamber 15 is exposed to HI-S pressure upstream of the fixed orifice 41 and the downstream pressure in passage 3 to which the upper end of the priority spool 43 is exposed in chamber 12 through the orifice 45 is the LO-S pressure signal to pump 10. Referring to FIG. 3A, the LO-S pressure in passage 3 is conducted to the pump controller by way of the passage 49, the check valve 46, and the conduit 44. If the pressure drop across the fixed orifice 41 increases above the predetermined value, flow to the priority circuit is pinched down at the openings 47 in the spool land 48 with excess flow being available in the auxiliary circuit 8 from passage 3. When the pressure drop across the fixed orifice 41 is less than the predetermined amount, the priority spool 41 is urged downwardly whereby the flow to the auxiliary circuit 8 is pinched down by the metering notches in said land 48 until the priority circuit is supplied with predetermined flow as determined by the fixed orifice 41 and the pressure drop thereacross.

When the FIG. 3 priority control valve 1'' is used with the inlet port 9 connected to a fixed displacement pump (not shown) the passage 49 and check valve 46 are not required.

The embodiments of the invention in which an exclusive property or privilege is claimed are defined as follows:

1. A hydraulic system including a fluid pressure source, a priority circuit having a priority fluid motor and a closed center control valve therefor with a variable area orifice therein, and an auxiliary circuit having at least one auxiliary fluid motor and a closed center control valve therefor with a variable area meter-in orifice in the pressure feed path to said auxiliary fluid motor and having a port exposed to pressure downstream of said meter-in orifice via a check valve and communicated with a control for said fluid pressure source which senses the pressure drop across said meter-in orifice; a priority control valve comprising a housing having a bore intersected axially therealong by single inlet, priority circuit supply, and auxiliary circuit supply passages respectively communicated with said fluid pressure source, said priority circuit control valve, and said auxiliary circuit control valve; said inlet passage intersecting said bore axially between said priority circuit supply and auxiliary circuit supply passages; a spring biased priority valve spool movable in opposite directions in said bore and having an intermediate land to restrict flow from said inlet passage to said priority supply passage when moved in one direction and to said auxiliary supply passage when moved in the opposite direction in response to the pressure drop across said priority circuit control valve orifice being greater than or less than a predetermined value; said spool having its ends respectively exposed to pressure upstream and downstream of said priority control valve orifice; one end of said spool being communicated with said control for said fluid pressure source via a passage in said housing having a check valve therein; said priority circuit control valve orifice being a variable area meter-out orifice; and said housing having a return passage from the priority circuit control valve, the other end of said spool being exposed to downstream pressure in said return passage.

2. A hydraulic system including a fluid pressure source, a priority circuit having a priority fluid motor and a closed center control valve therefor with a variable area orifice therein, and an auxiliary circuit having at least one auxiliary fluid motor and a closed center control valve therefor with a variable area meter-in orifice in the pressure feed path to said auxiliary fluid motor and having a port exposed to pressure downstream of said meter-in orifice via a check valve and communicated with a control for said fluid pressure source which senses the pressure drop across said meter-in orifice; a priority control valve comprising a housing having a bore intersected axially therealong by single inlet, priority circuit supply, and auxiliary circuit supply passages respectively communicated with said fluid pressure source, said priority circuit control valve, and said auxiliary circuit control valve; said inlet passage intersecting said bore axially between said priority circuit supply and auxiliary circuit supply passages; a spring biased priority valve spool movable in opposite directions in said bore and having an intermediate land to restrict flow from said inlet passage to said priority supply passage when moved in one direction and to said auxiliary supply passage when moved in the opposite direction in response to the pressure drop across said priority circuit control valve orifice being greater than or less than a predetermined value; said spool having its ends respectively exposed to pressure upstream and downstream of said priority control valve orifice; one end of said spool being communicated with said control for said fluid pressure source via a passage in said housing having a check valve therein; said priority circuit control valve orifice being a variable area meter-out orifice; said check valve in said housing blocking flow from said auxiliary supply passage to the end of said priority spool which is exposed to pressure upstream of said meter-out orifice.

3. A hydraulic system including a fluid pressure source, a priority circuit having a priority fluid motor and a closed center control valve therefor with a variable area orifice therein, and an auxiliary circuit having at least one auxiliary fluid motor and a closed center control valve therefor with a variable area meter-in orifice in the pressure feed path to said auxiliary fluid motor and having a port exposed to pressure downstream of said meter-in orifice via a check valve and communicated with a control for said fluid pressure source which senses the pressure drop across said meter-in orifice; a priority control valve comprising a housing having a bore intersected axially therealong by single inlet, priority circuit supply, and auxiliary circuit supply passages respectively communicated with said fluid pressure source, said priority circuit control valve, and said auxiliary circuit control valve; said inlet passage intersecting said bore axially between said priority circuit supply and auxiliary circuit supply passages; a spring biased priority valve spool movable in opposite directions in said bore and having an intermediate land to restrict flow from said inlet passage to said priority supply passage when moved in one direction and to said auxiliary supply passage when moved in the opposite direction in response to the pressure drop across said priority circuit control valve orifice being greater than or less than a predetermined value; said spool having its ends respectively exposed to pressure upstream and downstream of said priority control valve orifice; one end of said spool being communicated with said control for said fluid pressure source via a passage in said housing having a check valve therein; said priority circuit control valve orifice being a variable area meter-out orifice; said housing having another orifice which communicates the other end of said priority spool with a return passage in said housing which is exposed to pressure downstream of said meter-out orifice.

4. The hydraulic system of claim 3 wherein said check valve in said housing blocks flow from said auxiliary passage to said one end of said priority spool which is exposed to pressure upstream of said meter-out orifice.

5. A hydraulic system including a fluid pressure source, a priority circuit having a priority fluid motor and a closed center control valve therefor with a variable area orifice therein, and an auxiliary circuit having at least one auxiliary fluid motor and a closed center control valve therefor with a variable area meter-in orifice in the pressure feed path to said auxiliary fluid motor and having a port exposed to pressure downstream of said meter-in orifice via a check valve and communicated with a control for said fluid pressure source which senses the pressure drop across said meter-in orifice; a priority control valve comprising a housing having a bore intersected axially therealong by inlet, priority circuit supply, and auxiliary circuit supply passages respectively communicated with said fluid pressure source, said priority circuit control valve, and said auxiliary circuit control valve; a spring biased priority valve spool movable in opposite directions in said bore to restrict flow from said inlet passage to said priority supply passage when moved in one direction and to said auxiliary supply passage when moved in the opposite direction in response to the pressure drop across said priority circuit control valve orifice being greater than or less than a predetermined value; said spool having its ends respectively exposed to pressure upstream and downstream of said priority circuit control valve orifice independently of the pressure drop across said meter-in orifice when said control valves are operated simultaneously to actuate said priority and auxiliary fluid motors; said priority circuit control valve orifice being a variable area meter-out orifice; and a check valve in said housing blocking flow in a passage in said housing from said auxiliary supply passage to the end of said priority spool which is exposed to pressure upstream of said meter-out orifice when said control valves are operated simultaneously.

6. The hydraulic system of claim 5 wherein there is another orifice in said housing which communicates the other end of said priority spool with a return passage in said housing which is exposed to pressure downstream of said meter-out orifice.

* * * * *